US008567203B2

(12) United States Patent
Jang et al.

(10) Patent No.: US 8,567,203 B2
(45) Date of Patent: Oct. 29, 2013

(54) AIR CONDITIONER AND DEFROSTING OPERATION METHOD OF THE SAME

(75) Inventors: Ji Young Jang, Seoul (KR); Chi Woo Song, Seoul (KR); Baik Young Chung, Seoul (KR); Sai Kee Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 940 days.

(21) Appl. No.: 12/652,397

(22) Filed: Jan. 5, 2010

(65) Prior Publication Data

US 2010/0170270 A1 Jul. 8, 2010

(30) Foreign Application Priority Data

Jan. 6, 2009 (KR) ..... 10-2009-0000925

(51) Int. Cl.
*F25B 41/00* (2006.01)

(52) U.S. Cl.
USPC ..... 62/81

(58) Field of Classification Search
USPC ..... 62/81, 277, 498, 513
See application file for complete search history.

(56) References Cited

U.S. PATENT DOCUMENTS

| | | | | |
|---|---|---|---|---|
| 4,313,313 | A * | 2/1982 | Chrostowski et al. | 62/278 |
| 4,373,350 | A * | 2/1983 | Noland | 62/156 |
| 4,774,813 | A | 10/1988 | Yokoyama | |
| 5,771,699 | A | 6/1998 | Ponder | |
| 2006/0144060 | A1 | 7/2006 | Birgen | |

FOREIGN PATENT DOCUMENTS

WO WO 96/39602 12/1996

* cited by examiner

*Primary Examiner* — Melvin Jones
(74) *Attorney, Agent, or Firm* — McKenna Long & Aldridge LLP

(57) ABSTRACT

An air conditioner is provided, in which some of a plurality of outdoor heat exchangers implement a defrosting operation and others implement a heating operation. The air conditioner includes a compressor to compress refrigerant, a hot gas pipe to which a part of the refrigerant compressed in the compressor is moved, a 4-way valve to which the remaining refrigerant compressed in the compressor is moved, an indoor heat exchanger in which the refrigerant, having passed through the 4-way valve, undergoes heat exchange with indoor air, and a plurality of outdoor heat exchangers, some of which implement a heating operation as the heat-exchanged refrigerant from the indoor heat exchanger is moved therethrough while others implement a defrosting operation as the refrigerant having passed through the hot gas pipe is moved therethrough.

23 Claims, 12 Drawing Sheets

AIR CONDITIONER AND DEFROSTING OPERATION METHOD OF THE SAME

The present application claims priority to Korean Application No. 10-2009-0000925 filed in Korea on Jan. 6, 2009, the entire contents of which are hereby incorporated by reference in their entirety.

BACKGROUND OF THE INVENTION

1. Field of the Invention

The present invention relates to an air conditioner, and more particularly, to an air conditioner in which some of a plurality of outdoor heat exchangers may implement a defrosting operation and others may implement a heating operation.

2. Discussion of the Related Art

Generally, an air conditioner is an apparatus to cool or heat a room by using a refrigeration cycle including a compressor, an outdoor heat exchanger, an expansion unit, and an indoor heat exchanger. Specifically, the air conditioner may include a cooling unit to cool a room, and a heating unit to heat a room. In addition, a combined cooling/heating air conditioner to cool or heat a room may be realized.

The combined cooling/heating air conditioner may include a 4-way valve to change a flow of compressed refrigerant from the compressor depending upon whether a cooling operation or a heating operation is selected. During the cooling operation, the refrigerant compressed in the compressor is directed to the outdoor heat exchanger by way of the 4-way valve with the outdoor heat exchanger serving as a condenser. The condensed refrigerant after having passed through the outdoor heat exchanger expands while passing through the expansion unit and thereafter is introduced into the indoor heat exchanger. In this case, the indoor heat exchanger serves as an evaporator, and the refrigerant evaporated in the indoor heat exchanger is returned into the compressor by way of the 4-way valve.

On the other hand, during a heating operation, the refrigerant compressed in the compressor is directed to the indoor heat exchanger by way of the 4-way valve with the indoor heat exchanger serving as a condenser. The condensed refrigerant after having passed through the indoor heat exchanger is introduced into the outdoor heat exchanger after being expanded in the expansion unit. In this case, the outdoor heat exchanger serves as an evaporator, and the refrigerant evaporated in the outdoor heat exchanger is returned into the compressor by way of the 4-way valve.

During the above described operation of the air conditioner, condensed water may form on a surface of the heat exchanger serving as an evaporator. Specifically, the cooling operation may cause condensed water to form on a surface of the indoor heat exchanger, whereas during the heating operation may cause condensed water to form on a surface of the outdoor heat exchanger. If the condensed water formed on the surface of the outdoor heat exchanger during the heating operation freezes, smooth flow of outdoor air may be prevented, and a heat exchange efficiency between the outdoor air and the refrigerant may deteriorate, resulting in poor heating performance.

Accordingly, to remove the condensed water generated during the heating operation, one might consider temporarily stopping the heating operation and driving the refrigeration cycle in reverse (i.e. to initiate a cooling operation), so that high temperature and high pressure refrigerant is directed to pass through the outdoor heat exchanger, causing any frost formed on the surface of the outdoor heat exchanger to melt due to the heat of the refrigerant. However, implementing a defrosting operation as described above via reversal of the refrigeration cycle has the problem of stopping the heating of a room.

SUMMARY OF THE INVENTION

An object of the present invention is to provide an air conditioner capable of heating a room while implementing a defrosting operation.

Another object of the present invention is to provide a defrosting operation method of an air conditioner capable of allowing a plurality of outdoor heat exchangers to efficiently implement a defrosting operation as well as a heating operation.

The objects of the present invention are not limited to the above-mentioned object and other objects that have not mentioned above will become evident to those skilled in the art from the following description.

To achieve the above object, there is provided an air conditioner according to an exemplary embodiment of the present invention, includes: a compressor to compress refrigerant; a hot gas pipe that receives a part of the refrigerant compressed in the compressor; a 4-way valve that receives the remaining refrigerant compressed in the compressor; an indoor heat exchanger that receives the refrigerant from the 4-way valve and that exchanges heat with indoor air; and a plurality of outdoor heat exchangers, some of which implement a heating operation as the heat-exchanged refrigerant from is received from the indoor heat exchanger and passes therethrough while others implement a defrosting operation as the refrigerant is received from the hot gas pipe.

To achieve the above objects, there is provided a defrosting operation method of an air conditioner according to an exemplary embodiment of the present invention, includes: performing a heating operation by moving refrigerant compressed in a compressor into an indoor heat exchanger; sequentially performing a defrosting operation of a plurality of outdoor heat exchangers by moving a part of the compressed refrigerant from the compressor into some of the plurality of outdoor heat exchangers; and resuming the heating operation by moving all of the compressed refrigerant from the compressor into the indoor heat exchanger.

Specific details of other embodiments are included in the following detailed description and the accompanying drawings.

DETAILED DESCRIPTION OF THE PREFERRED EMBODIMENTS

Figure 1:
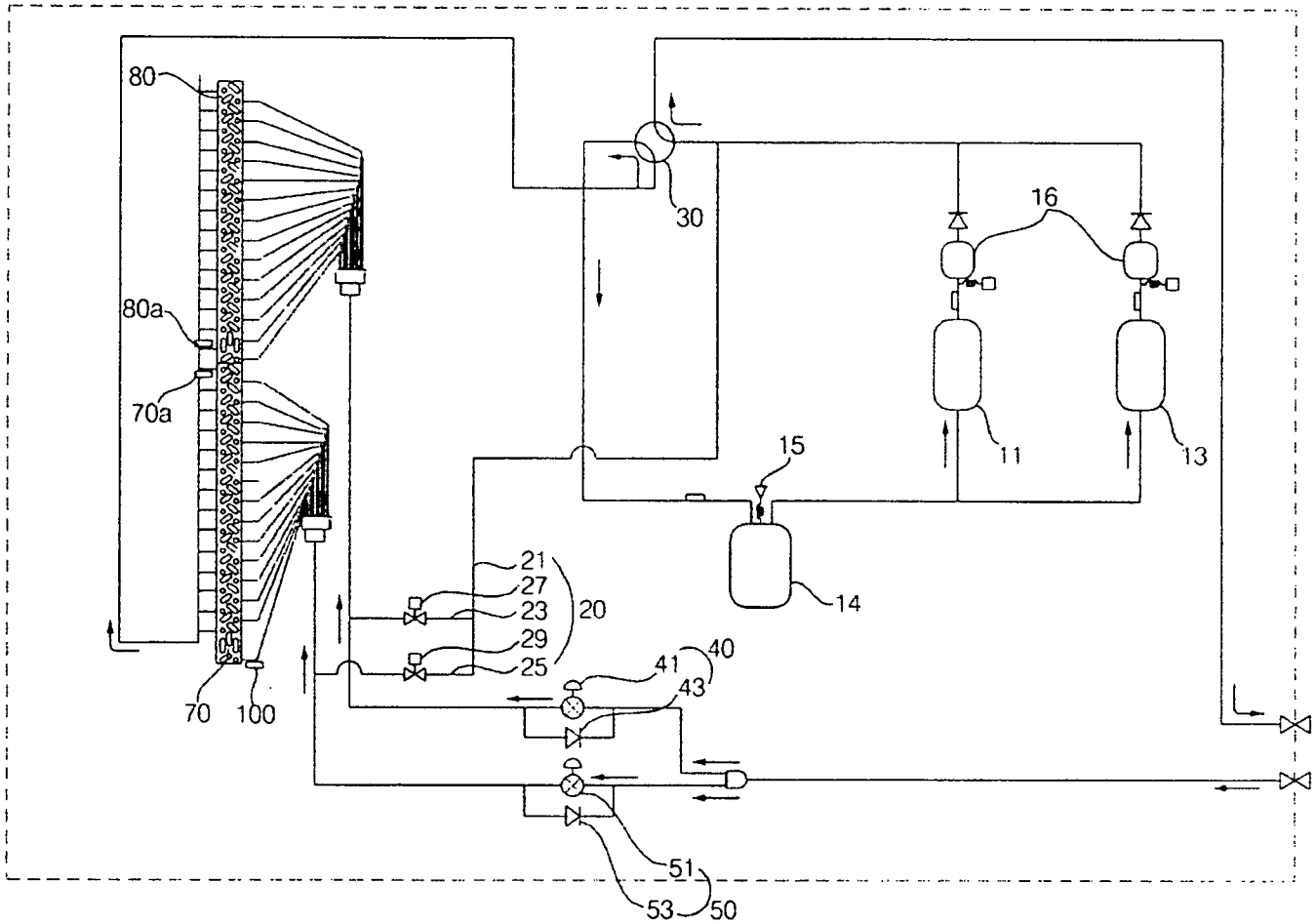
FIG. 1 is a block diagram illustrating the flow of refrigerant in an outdoor unit during a heating operation of an air conditioner according to a first embodiment of the present invention.

The advantages and features of the present invention, and the way of attaining them, will become apparent with reference to embodiments described below in conjunction with the accompanying drawings. However, the present invention is not limited to the embodiments disclosed below and will be embodied in a variety of different forms; rather, these embodiments are provided so that this disclosure will be thorough and complete, and will fully convey the scope of the present invention to those skilled in the art, and the scope of the present invention will be defined by the appended claims. Like reference numerals refer to like elements throughout the specification.

Figure 2:
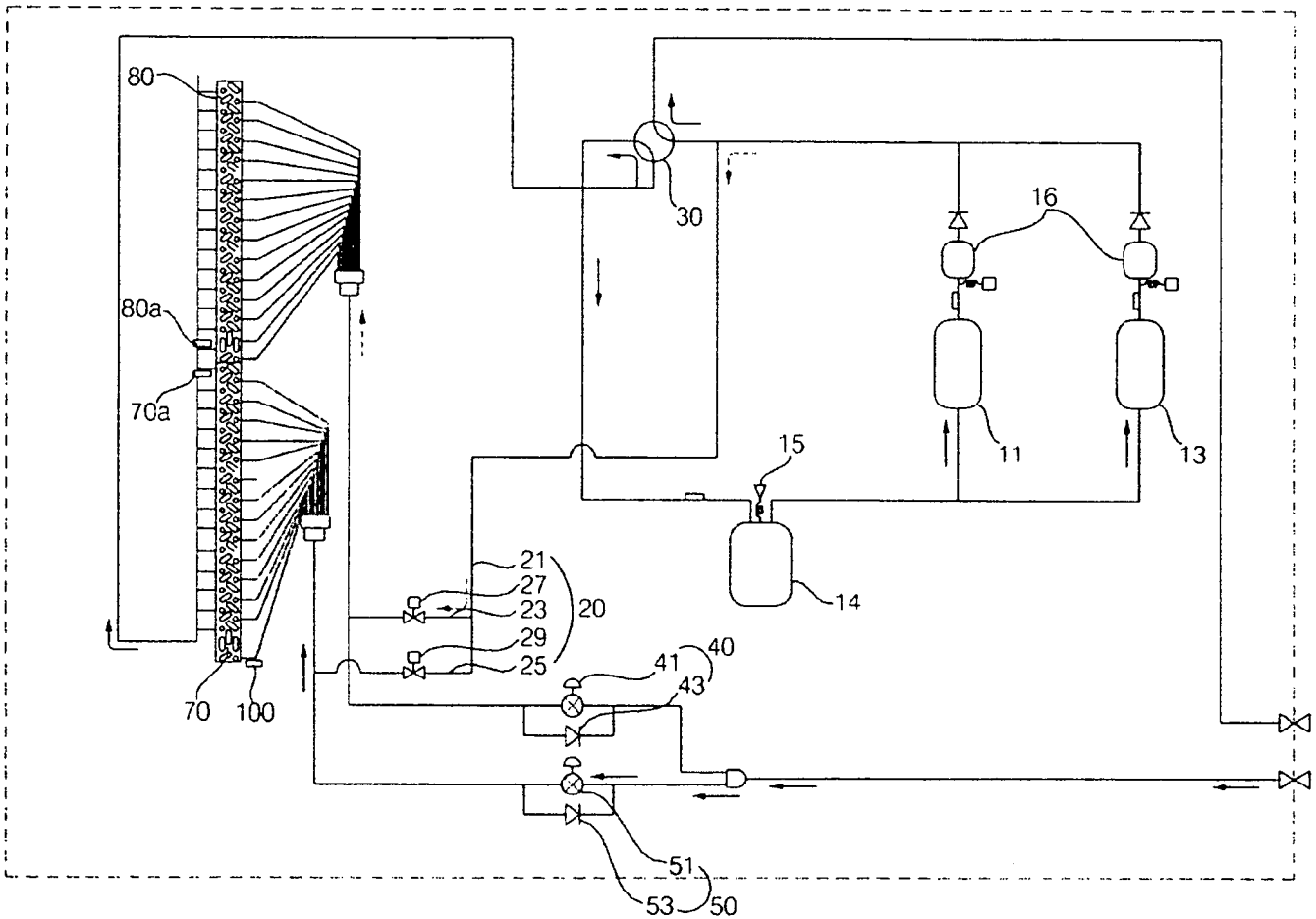
FIG. 2 is a block diagram illustrating the flow of refrigerant in the outdoor unit during a defrosting operation of a first outdoor heat exchanger according to the first embodiment of the present invention.
Figure 3:
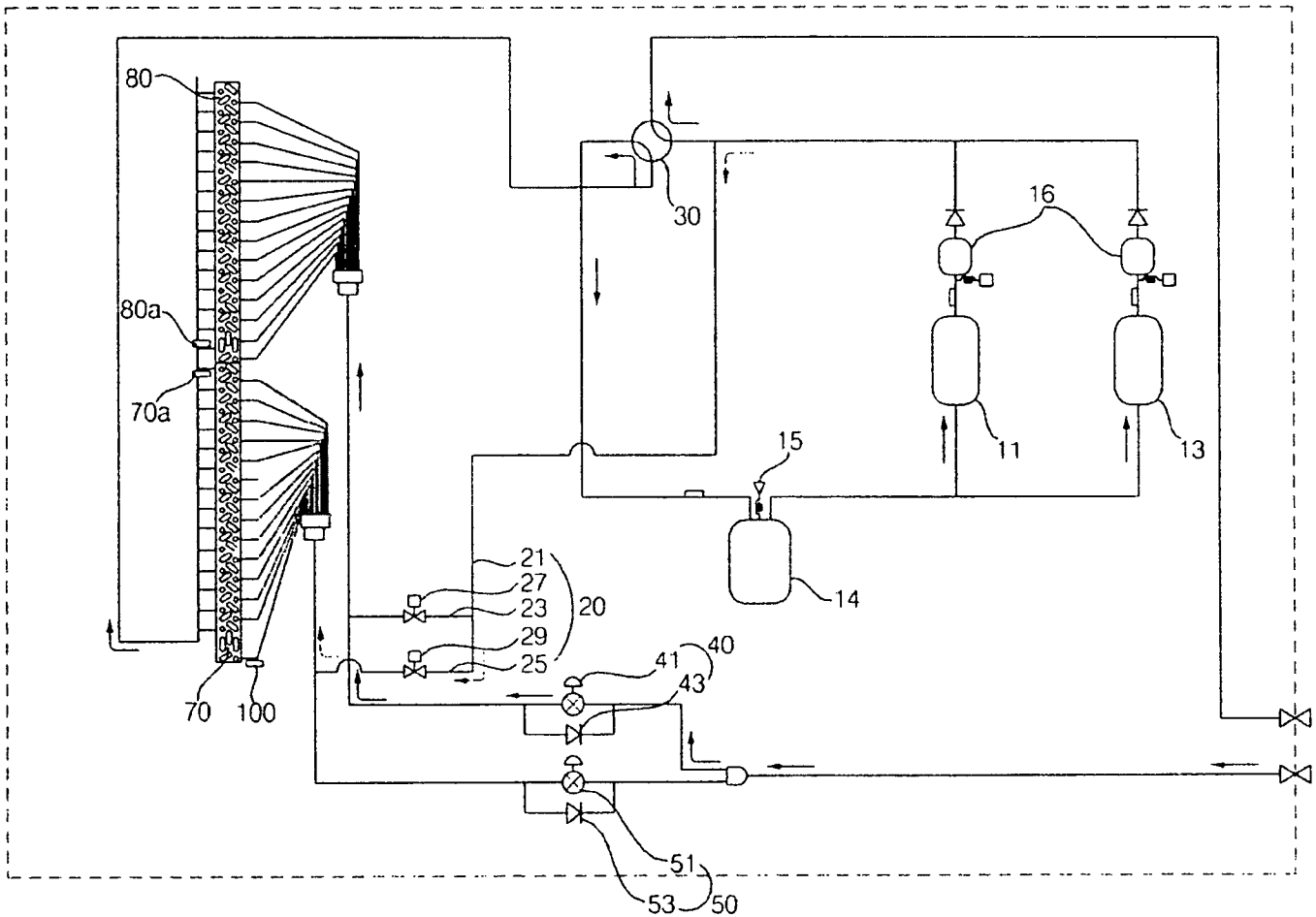
FIG. 3 is a block diagram illustrating the flow of refrigerant in the outdoor unit during a defrosting operation of a second outdoor heat exchanger according to the first embodiment of the present invention.

FIG. 1 is a block diagram illustrating the flow of refrigerant in an outdoor unit during a heating operation of an air conditioner according to a first embodiment of the present invention, FIG. 2 is a block diagram illustrating the flow of refrigerant in the outdoor unit during a defrosting operation of a first outdoor heat exchanger according to the first embodiment, and FIG. 3 is a block diagram illustrating the flow of refrigerant in the outdoor unit during a defrosting operation of a second outdoor heat exchanger according to the first embodiment. The general configuration of the air conditioner according to the present embodiment will be described with reference to FIGS. 1 to 3.

Although not shown, the air conditioner of the present embodiment may include a plurality of indoor units and a plurality of outdoor units. The plurality of indoor units and the plurality of outdoor units are connected to one another by use of refrigerant pipes. Also, the plurality of indoor units are installed in several location to be climate controlled.

Referring to FIG. 1, an outdoor unit of the air conditioner according to the present embodiment includes compressors, a hot gas pipe, a 4-way valve, an indoor heat exchanger, outdoor expansion units, and a plurality of outdoor heat exchangers.

The compressors 11 and 13 compress refrigerant. One of the compressors 11 and 13 may be a variable capacity compressor, such as an inverter compressor, etc., and the other compressor may be a constant speed compressor. A gas-liquid separator 14 is connected to suction side of the compressors 11 and 13, and oil separators 16 and check valves are installed near discharge sides of the compressors 11 and 13.

In the present embodiment, to determine whether to perform a defrosting operation, the pressure of the refrigerant is measured at the refrigerant inlet side of the compressor. So, the gas-liquid separator 14 of the present embodiment has a pressure sensor 15 to measure a pressure of the refrigerant at the suction side of the compressors 11 and 13. Alternatively, the pressure sensor 15 may be installed at an arbitrary position between the gas-liquid separator 14 and the compressors 11 and 13.

A part of the refrigerant compressed in the compressors 11 and 13 is moved to a hot gas pipe 20. More specifically, during a defrosting operation, a part of high temperature and high pressure refrigerant compressed in the compressors 11 and 13 is introduced into the outdoor heat exchangers 70 and 80 by passing through the hot gas pipe 20, thereby defrosting the outdoor heat exchangers 70 and 80.

The hot gas pipe 20 includes a main pipe 21, two connecting pipes 23 and 25, and two defrosting valves 27 and 29 installed on the respective connecting pipes 23 and 25.

A part of the refrigerant compressed in the compressors 11 and 13 is moved through the main pipe 21. Accordingly, the main pipe 21 may be connected to a pipe between the indoor heat exchanger (not shown) and the 4-way valve 30. However, in the present embodiment, one end of the main pipe 21 is connected to a position between the compressors 11 and 13 and the 4-way valve 30. With this arrangement, pressure loss of the refrigerant may be reduced in comparison to the case where the refrigerant compressed in the compressors 11 and 13 is moved to the main pipe 21 after passing through the 4-way valve 30. The other end of the main pipe 21 is connected to the connecting pipes 23 and 25 that will be described hereinafter. Accordingly, the refrigerant, having passed through the main pipe 21, is moved to the connecting pipes 23 and 25.

The connecting pipes 23 and 25 include a first connecting pipe 23 communicating with the first outdoor heat exchanger 80 and a second connecting pipe 25 communicating with the second outdoor heat exchanger 70. Accordingly, the refrigerant, having passed through the respective connecting pipes 23 and 25, is moved to the respective outdoor heat exchangers 70 and 80. The number of the connecting pipes 23 and 25 may be equal to the number of the outdoor heat exchangers 70 and 80.

The defrosting valves 27 and 29 include a first defrosting valve 27 installed on the first connecting pipe 23 and a second defrosting valve 29 installed on the second connecting pipe 25. The respective defrosting valves 27 and 29 serve to open or close the connecting pipes 23 and 25. More specifically, during a heating operation, the respective defrosting valves 27 and 29 are closed to prevent the refrigerant from being moved from the connecting pipes 23 and 25 to the respective outdoor heat exchangers 70 and 80. Meanwhile, during a defrosting operation of the first outdoor heat exchanger 80, the first defrosting valve 27 is opened to allow the refrigerant to be moved from the first connecting pipe 23 to the first outdoor heat exchanger 80. Also, during a defrosting operation of the second outdoor heat exchanger 70, the second defrosting valve 29 is opened to allow the refrigerant to be moved from the second connecting pipe 25 to the second outdoor heat exchanger 70.

The 4-way valve 30 serves to change a movement direction of the refrigerant according to a heating operation or a cooling operation of the air conditioner. Specifically, to implement a cooling operation, the 4-way valve 30 moves the refrigerant evaporated in the indoor heat exchanger (not shown) toward the compressors 11 and 13, and the refrigerant compressed in the compressors 11 and 13 toward the outdoor heat exchangers 70 and 80. On the other hand, to implement a heating operation, the 4-way valve 30 moves the refrigerant evaporated in the outdoor heat exchangers 70 and 80 toward the compressors 11 and 13, and the refrigerant compressed in the compressors 11 and 13 toward the indoor heat exchanger (not shown). Also, to implement a defrosting operation, the 4-way valve 30 moves the refrigerant evaporated in the outdoor heat exchangers 70 and 80 toward the compressors 11 and 13, and a part of the refrigerant compressed in the compressors 11 and 13, which has remained rather than being moved to the main pipe 21, toward the indoor heat exchanger (not shown).

The indoor heat exchanger (not shown) serves to cool or heat indoor air via heat exchange between the indoor air and the refrigerant. More specifically, during a cooling operation, the indoor heat exchanger serves as an evaporator to cool indoor air via evaporation of the refrigerant compressed in the compressors 11 and 13, whereas, during a heating operation, the indoor heat exchanger serves as a condenser to heat indoor air via condensation of the refrigerant compressed in the compressors 11 and 13. Also, during a defrosting operation, the refrigerant, having passed through the 4-way valve 30, is moved through the indoor heat exchanger, serving to heat indoor air. Although not shown, it will be appreciated that the present embodiment may employ a plurality of indoor heat exchangers to cool or heat a plurality of rooms.

The outdoor expansion units 40 and 50 include expansion valves 41 and 51 and check valves 43 and 53. During a heating operation, the refrigerant condensed in the indoor heat exchanger undergoes expansion while passing through the expansion valves 41 and 51. Also, during a cooling operation, the refrigerant, having passed through the outdoor heat exchangers 70 and 80, is moved through the check valves 43 and 53, thereby undergoing expansion in an indoor expansion unit (not shown).

The number of the outdoor expansion units 40 and 50 may be equal to the number of the outdoor heat exchangers 70 and 80. In the present embodiment, the outdoor expansion units 40 and 50 include a first outdoor expansion unit 40 connected to the first outdoor heat exchanger 80 and a second outdoor expansion unit 50 connected to the second outdoor heat exchanger 70. More specifically, in the present embodiment, the expansion valves 41 and 51 take the form of electronic expansion valves. An opening rate of the electronic expansion valves is limited to a minimum opening rate during the defrosting operation of the respective outdoor heat exchangers 70 and 80, so as to prevent cold refrigerant from being introduced into the outdoor heat exchanger 70 or 80 that is implementing the defrosting operation.

The plurality of outdoor heat exchangers 70 and 80 serve to condense/evaporate the refrigerant passing therethrough by use of outdoor air. During a defrosting operation, the refrigerant compressed in the compressors 11 and 13 is introduced into the outdoor heat exchangers 70 and 80, thereby serving to remove condensed water formed on the outdoor heat exchangers 70 and 80.

Although various numbers of the outdoor heat exchangers 70 and 80 may be provided, the present embodiment exemplifies the first outdoor heat exchanger 80 and the second outdoor heat exchanger 70. During a cooling operation, the refrigerant is condensed by outdoor air while passing through the first outdoor heat exchanger 80 and the second outdoor heat exchanger 70. On the other hand, during a heating operation, the refrigerant is evaporated by outdoor air while passing through the first outdoor heat exchanger 80 and the second outdoor heat exchanger 70.

Also, when the first outdoor heat exchanger 80 implements a defrosting operation, the compressed refrigerant from the compressors 11 and 13 is introduced into the first outdoor heat exchanger 80 by passing through the main pipe 21 and the first connecting pipe 27. In this case, the second outdoor heat exchanger 70 implements a heating operation as the refrigerant, having passed through the second outdoor expansion valve 51, is introduced into the second outdoor heat exchanger 70. In conclusion, in the present invention, one of the plurality of outdoor heat exchangers 70 and 80 implements the defrosting operation, and the other one implements the heating operation. Thereby, heated air can be continuously supplied into a room even during implementation of the defrosting operation.

The first outdoor heat exchanger 80 and the second outdoor heat exchanger 70 are provided with temperature sensors 70*a* and 80*a*, respectively, to measure a temperature of the refrigerant discharged from the respective outdoor heat exchangers 70 and 80. Also, an additional temperature sensor 100 is provided at the outdoor heat exchangers 70 and 80, to measure a temperature of outdoor air or a temperature of the refrigerant to be introduced into the respective outdoor heat exchangers 70 and 80. In addition, to determine whether to implement a defrosting operation, a temperature of outdoor air having passed through the outdoor heat exchangers 70 and 80 may be measured.

Although not shown, the outdoor heat exchangers 70 and 80 may include a plurality of blowers to blow outdoor air to the respective outdoor heat exchangers 70 and 80. In the present embodiment, a first blower to blow outdoor air into the first outdoor heat exchanger 80 and a second blower to blow outdoor air into the second outdoor heat exchanger 70 are provided. When the air conditioner implements a cooling operation or a heating operation, both the first blower and the second blower are operated.

When the first outdoor heat exchanger 80 implements a defrosting operation and the second outdoor heat exchanger 70 implements a heating operation, the second blower is operated to blow outdoor air into the second outdoor heat exchanger 70. However, the first blower is not operated, so as to prevent cold air from moving to the first outdoor heat exchanger 80 that is implementing the defrosting operation. This may increase defrosting efficiency of the first outdoor heat exchanger 80. Similarly, the second blower is not operated during the defrosting operation of the second outdoor heat exchanger 70.

Hereinafter, operational effects and a defrosting operation method of the air conditioner having the above described configuration according to the first embodiment of the present invention will be described.

Figure 4:
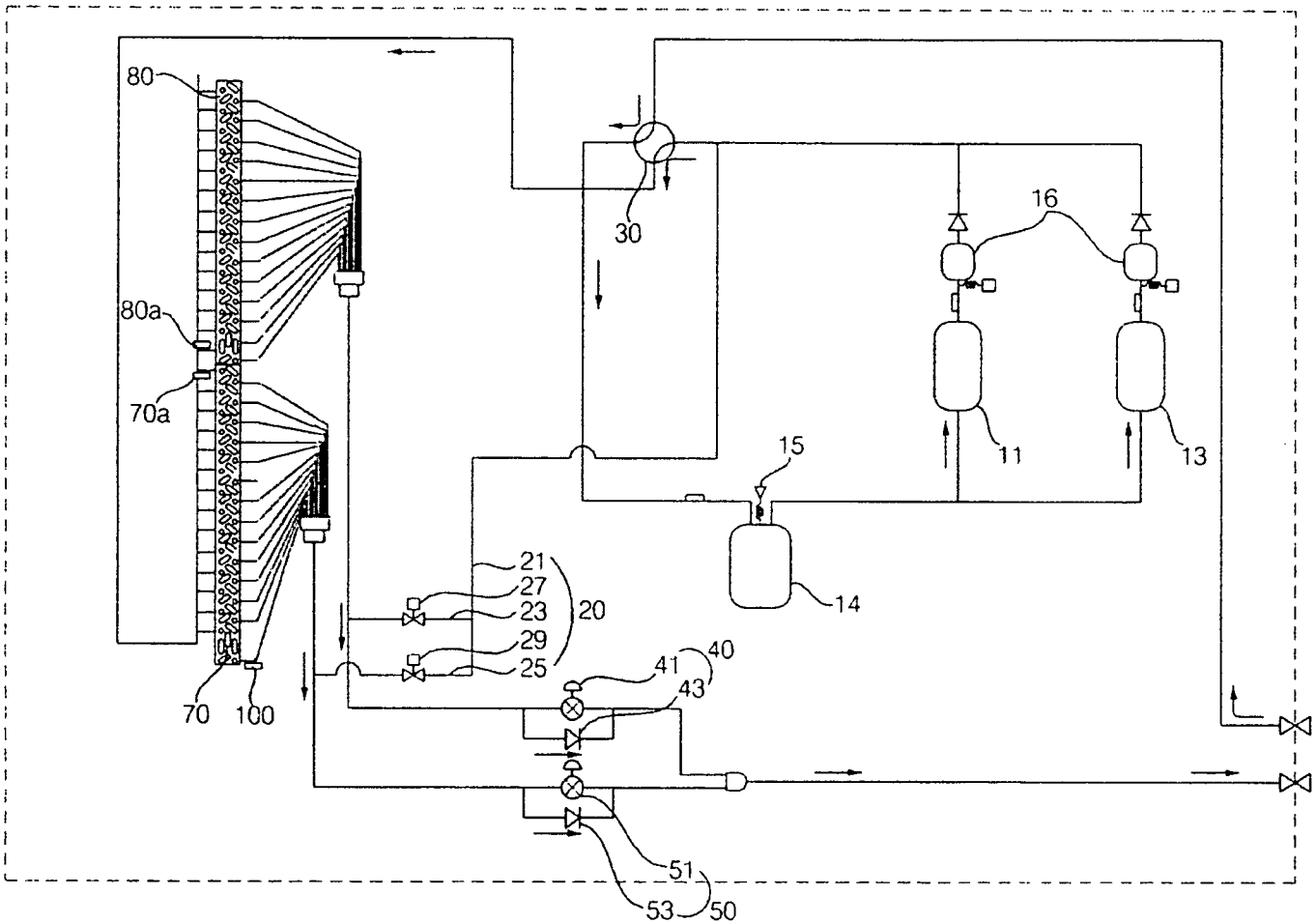
FIG. 4 is a block diagram illustrating the flow of refrigerant during a cooling operation of the air conditioner according to the first embodiment of the present invention.

FIG. 4 is a configuration view illustrating the flow of refrigerant during a cooling operation of the air conditioner according to the present invention. Now, the flow of refrigerant during a cooling operation of the air conditioner according to the present embodiment will be described with reference to FIG. 4.

During a cooling operation, the refrigerant is compressed in the compressors 11 and 13 and is moved to the 4-way valve 30. In this case, the first defrosting valve 27 and the second defrosting valve 29 are kept closed to allow all the refrigerant compressed in the compressors 11 and 13 to be moved to the 4-way valve 30. Then, the refrigerant, having passed through the 4-way valve 30, is introduced into the first outdoor heat exchanger 80 and the second outdoor heat exchanger 70, thereby being condensed while undergoing heat exchange with outdoor air blown by the first blower and the second blower.

Subsequently, the refrigerant, having passed through the first outdoor heat exchanger 80 and the second outdoor heat exchanger 70, is moved through the first check valve 43 and the second check valve 53 and subsequently, undergoes expansion in the indoor expansion unit (not shown). The resulting expanded refrigerant is evaporated while passing through the indoor heat exchanger (not shown). In this case, as indoor air undergoes heat exchange with the refrigerant while passing through the indoor heat exchanger, the temperature of the indoor air is lowered, thereby serving to cool a room. The refrigerant, having passed through the indoor heat exchanger, is returned into the compressors 11 and 13 by passing through the 4-way valve 30 and then the gas-liquid separator 14.

FIG. 1 is a block diagram illustrating the flow of refrigerant during a heating operation of the air conditioner according to the present invention. The flow of refrigerant during a heating operation of the air conditioner according to the present embodiment will be described with reference to FIG. 1.

During a heating operation, the refrigerant is compressed in the compressors 11 and 13 and is moved to the 4-way valve 30. In this case, the first defrosting valve 27 and the second defrosting valve 29 are kept closed to allow all of the refrigerant compressed in the compressors 11 and 13 to be moved to the 4-way valve 30. Then, the refrigerant, having passed through the 4-way valve 30, is introduced into the indoor heat exchanger (not shown), thereby being condensed while undergoing heat exchange with indoor air.

Subsequently, the refrigerant, having passed through the indoor heat exchanger (not shown), is moved through the indoor expansion unit (not shown) and undergoes expansion while passing through the first expansion valve 41 and the second expansion valve 51. The refrigerant, having passed through the first expansion valve 41, is introduced into and is evaporated in the first outdoor heat exchanger 80 via heat exchange with outdoor air blown by the first blower, thereby increasing a temperature of the outdoor air and consequently, allowing the outdoor air to heat a room. Also, the refrigerant, having passed through the second expansion valve 51, is introduced into and is evaporated in the second outdoor heat exchanger 70 via heat exchange with outdoor air blown by the second blower, thereby increasing a temperature of the outdoor air and consequently, allowing the outdoor air to heat a room. The resulting expanded refrigerant, having passed through the first outdoor heat exchanger 80 and the second outdoor heat exchanger 70, is returned into the compressors 11 and 13 by sequentially passing through the 4-way valve 30 and the gas-liquid separator 14.

FIG. 2 is a block diagram illustrating the flow of refrigerant when the first outdoor heat exchanger 80 implements a defrosting operation.

Referring to FIG. 2, in the air conditioner according to the present embodiment, when the first outdoor heat exchanger 80 performs a defrosting operation, the second outdoor heat exchanger 70 performs a heating operation. Accordingly, the first defrosting valve 27 is opened, whereas the first expansion valve 41 is kept at a minimum opening rate or is closed.

More specifically, a part of the refrigerant compressed in the compressors 11 and 13 is moved into the hot gas pipe 20, and the remaining compressed refrigerant is moved from the compressors 11 and 13 to the 4-way valve 30.

The refrigerant moved into the hot gas pipe 20 is introduced into the first outdoor heat exchanger 80 by sequentially passing through the main pipe 21, the first connecting pipe 23, and the first defrosting valve 27, thereby acting to remove frost formed on the first outdoor heat exchanger 80. Then, the refrigerant is returned to the compressors 11 and 13 by passing through the 4-way valve 30.

On the other hand, the remaining refrigerant moved to the 4-way valve 30 sequentially undergoes condensation in the indoor heat exchanger (not shown), expansion by the second expansion valve 51, and evaporation in the second outdoor heat exchanger 70. As the refrigerant, having passed through the 4-way valve 30, is returned into the compressors 11 and 13, the above described heating cycle may be continuously maintained.

FIG. 3 is a configuration view illustrating the flow of refrigerant when the second outdoor heat exchanger 70 implements a defrosting operation. Referring to FIG. 3, when the second outdoor heat exchanger 70 performs a defrosting operation, the first outdoor heat exchanger 80 performs a heating operation. In this case, the flow of refrigerant is similar to that in the above described defrosting operation of the first outdoor heat exchanger 80 and thus, a description thereof will not be included.

Figure 5:
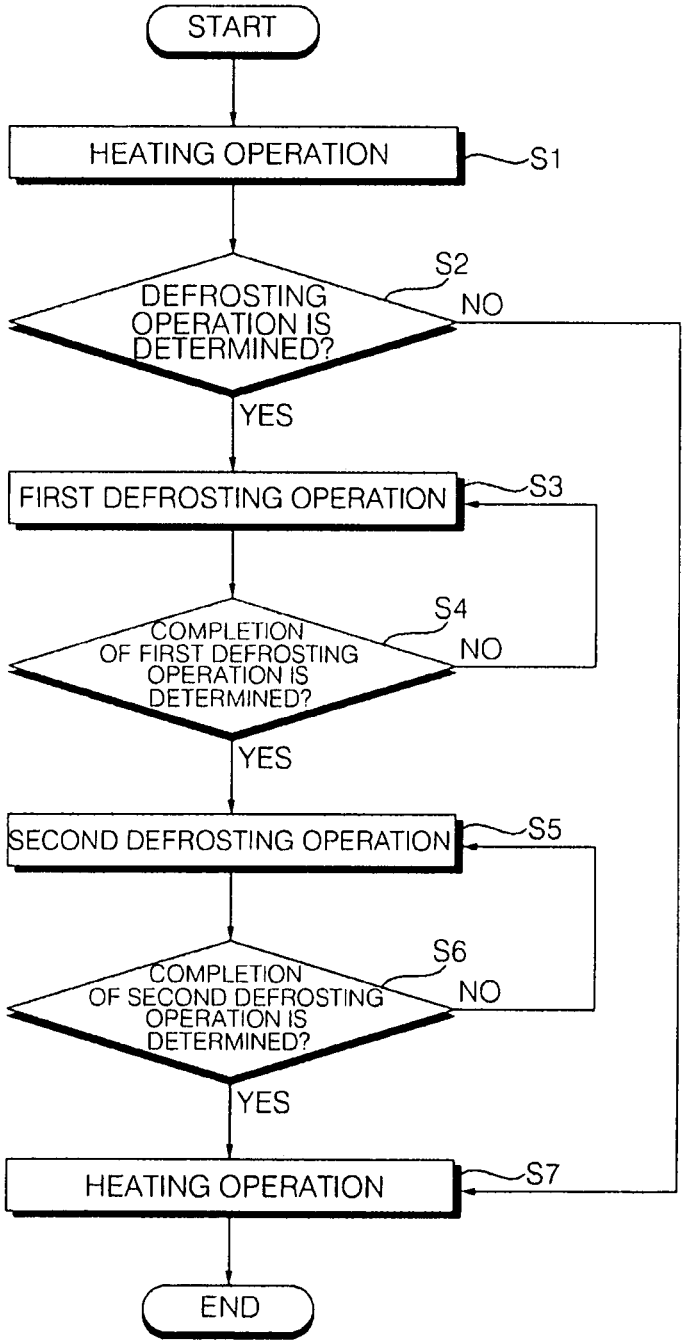
FIG. 5 is a flow chart illustrating a method of defrosting the air conditioner according to the first embodiment of the present invention.

FIG. 5 is a flow chart illustrating a method of defrosting the air conditioner according to the present embodiment. The defrosting operation method of the air conditioner according to the present embodiment will be described with reference to FIG. 5.

First, heating of a room is performed as the refrigerant compressed in the compressors 11 and 13 is moved into the indoor heat exchanger by way of the 4-way valve 30 (S1).

During implementation of the heating operation of the air conditioner, it is determined whether either the second outdoor heat exchanger 70 or the first outdoor heat exchanger 80 exhibits frost build up (S2).

Here, the frost build up is determined based on the presence of frost on the outdoor heat exchangers 70 and 80. Specifically, if condensed water on the outdoor heat exchangers 70 and 80 freezes, the outdoor heat exchangers 70 and 80 exhibit deteriorated heat exchange efficiency. The presence of frost on the outdoor heat exchangers 70 and 80 may be determined based on various measured values with respect to the refrigeration cycle of the air conditioner.

More specifically, the presence of frost may be determined by measuring a pressure and temperature of the refrigerant at different positions of the overall refrigeration cycle and comparing the measured values with values measured during a normal operation. In addition, the presence of frost may be determined by measuring a temperature of outdoor air at the outdoor heat exchangers 70 and 80. In this case, a temperature of outdoor air having passed through the outdoor heat exchanger may be measured, or a temperature of outdoor air may be measured at a refrigerant inlet of the outdoor heat exchanger.

Furthermore, the presence of frost on the outdoor heat exchangers 70 and 80 may be determined via mutual comparison of the above mentioned measured values. Specifically, to determine the presence of frost on the outdoor heat exchangers 70 and 80, the gradient of a line on a P-H chart determined by pressure and temperature values measured at refrigerant inlets and refrigerant outlets of the outdoor heat exchangers 70 and 80 as well as pressure and temperature values measured at refrigerant inlets of the compressors 11 and 13 may be compared with that of a normal operation.

When the presence of frost on the outdoor heat exchangers 70 and 80 is determined based on the above described measured values, it is determined that the air conditioner requires defrosting.

Once the need for defrosting is determined, a part of the refrigerant compressed in the compressors 11 and 13 is directed to the hot gas pipe 20 and is introduced into some of the plurality of outdoor heat exchangers. Thereby, a defrosting operation is performed in such a manner that the plurality of outdoor heat exchangers sequentially undergo a defrosting operation.

In the present embodiment, the plurality of outdoor heat exchangers includes the first outdoor heat exchanger 80 and the second outdoor heat exchanger 70. Also, the defrosting operation includes implementing a first defrosting operation (S3), determining when to complete the first defrosting operation (S4), implementing a second defrosting operation (S5), and determining when to complete the second defrosting operation (S6).

In the first defrosting operation (S3), a part of the refrigerant compressed in the compressors 11 and 13 is introduced into the first outdoor heat exchanger 80 by passing through the hot gas pipe 20, whereas the remaining compressed refrigerant is moved from the compressors 11 and 13 into the second outdoor heat exchanger 70 by sequentially passing through the 4-way valve 30, the indoor heat exchanger (not shown), and the second outdoor expansion valve 51. Accordingly, the first outdoor heat exchanger 80 implements a defrosting operation, and the second outdoor heat exchanger 70 implements a heating operation.

More specifically, although not shown in FIG. 5, the first defrosting operation (S3) includes opening the first defrosting valve 27 and limiting the opening rate of the first expansion valve 41.

The first defrosting valve 27 is opened to allow the refrigerant, having passed through the main pipe 21, to be moved from the first connecting pipe 23 into the first outdoor heat exchanger 80.

By limiting the opening rate of the first expansion valve 41, the first expansion valve 41 is kept at a minimum opening rate or is closed to substantially prevent the refrigerant condensed in the indoor heat exchanger from being moved into the first outdoor heat exchanger 80 through the first expansion valve 41. Accordingly, most of the refrigerant, having passed through the indoor heat exchanger, is moved into the second outdoor heat exchanger 70 by passing through the second expansion valve 51.

To determine when to complete the first defrosting operation, a temperature of the refrigerant at the first outdoor heat exchanger 80 is measured (S4). When the temperature of the refrigerant discharged from the first outdoor heat exchanger 80 is not equal to a preset temperature that is a standard indication of when to complete a defrosting operation, the first defrosting operation (S3) is continuously implemented. When the temperature of the refrigerant is equal to the preset temperature, the second defrosting operation (S5) is implemented.

During the second defrosting operation (S5), a part of the refrigerant compressed in the compressors 11 and 13 is introduced into the second outdoor heat exchanger 70, whereas the remaining compressed refrigerant is moved from the compressors 11 and 13 into the first outdoor heat exchanger 80 by sequentially passing through the 4-way valve 30, the indoor heat exchanger (not shown), and the first outdoor expansion valve 41. Accordingly, the first outdoor heat exchanger 80 performs a heating operation, and the second outdoor heat exchanger 70 performs a defrosting operation.

More specifically, although not shown in FIG. 5, the second defrosting operation (S5) includes opening the second defrosting valve 29 and limiting the opening rate of the second expansion valve 51.

The first defrosting valve 27 is closed, and the second defrosting valve 29 is opened to allow the refrigerant, having passed through the main pipe 21, to be moved from the second connecting pipe 25 into the second outdoor heat exchanger 70.

By limiting the opening rate of the second expansion valve 51, the first expansion valve 41 is reset to a normal opening rate, whereas the second expansion valve 51 is kept at a minimum opening rate or is closed. Accordingly, most of the refrigerant, having passed through the indoor heat exchanger, is moved into the first outdoor heat exchanger 80 by passing through the first expansion valve 41.

To determine when to complete the second defrosting operation, a temperature of the refrigerant at the second outdoor heat exchanger 70 is measured (S6).

When the temperature of the refrigerant discharged from the second outdoor heat exchanger 70 is not equal to the preset temperature that is a standard indication of when to complete a defrosting operation, the second defrosting operation (S5) is continuously implemented. When the temperature of the refrigerant is equal to the preset temperature, the first defrosting valve 27 and the second defrosting valve 29 are closed and the first expansion valve 41 and the second expansion valve 51 are reset to a normal opening rate, allowing a heating operation to be performed (S7).

Figure 6:
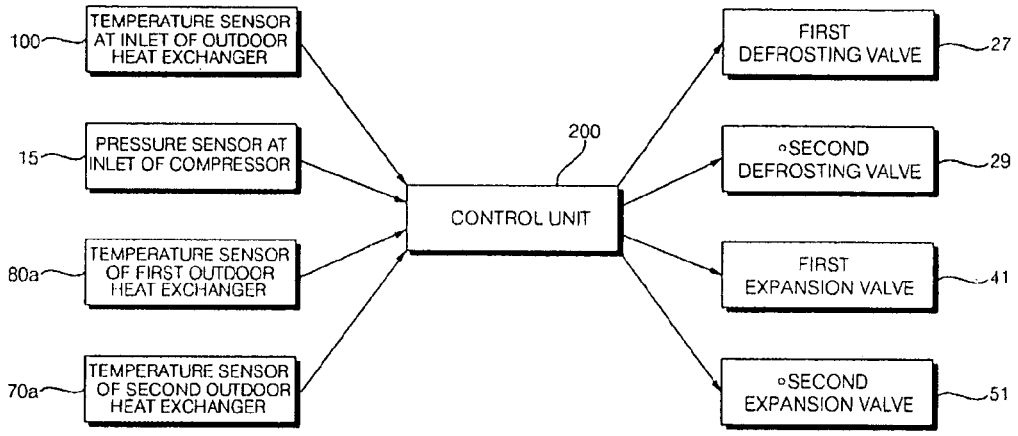
FIG. 6 is a control block diagram illustrating the defrosting operation of the air conditioner according to the first embodiment of the present invention.

FIG. 6 is a control block diagram illustrating the defrosting operation of the air conditioner according to the present embodiment.

Referring to FIG. 6, the air conditioner according to the present embodiment further includes a control unit 200. Based on the above described defrosting method of the air conditioner according to the present embodiment, the control unit 200 compares values related to the normal operation of the air conditioner with measured values from various sensors, such as, e.g., the temperature sensor 100 that measures the temperature of outdoor air or the temperature of the refrigerant to be introduced into the outdoor heat exchangers 70 and 80, the pressure sensor 15 that measures the pressure of the refrigerant to be introduced into the compressors 11 and 13, and the temperature sensors 70*a* and 80*a* that measure the temperature of the refrigerant discharged from the respective outdoor heat exchangers 70 and 80.

When the presence of frost on the outdoor heat exchangers 70 and 80 is determined from the comparative results, the control unit 200 controls opening/closing of the first defrosting valve 27, the second defrosting valve 29, the first expansion valve 41, and the second expansion valve 51, based on the above described defrosting method of the air conditioner according to the present embodiment.

In the present embodiment, as a result, one of the first outdoor heat exchanger 80 and the second outdoor heat exchanger 70 performs a defrosting operation, and the other one performs a heating operation. In addition, if four outdoor heat exchangers are provided, the outdoor heat exchangers may be gathered two by two into a first outdoor heat exchanger group and a second outdoor heat exchanger group. Even in this case, the defrosting method may be accomplished in the same manner as the above described defrosting method of the present embodiment.

Figure 7:
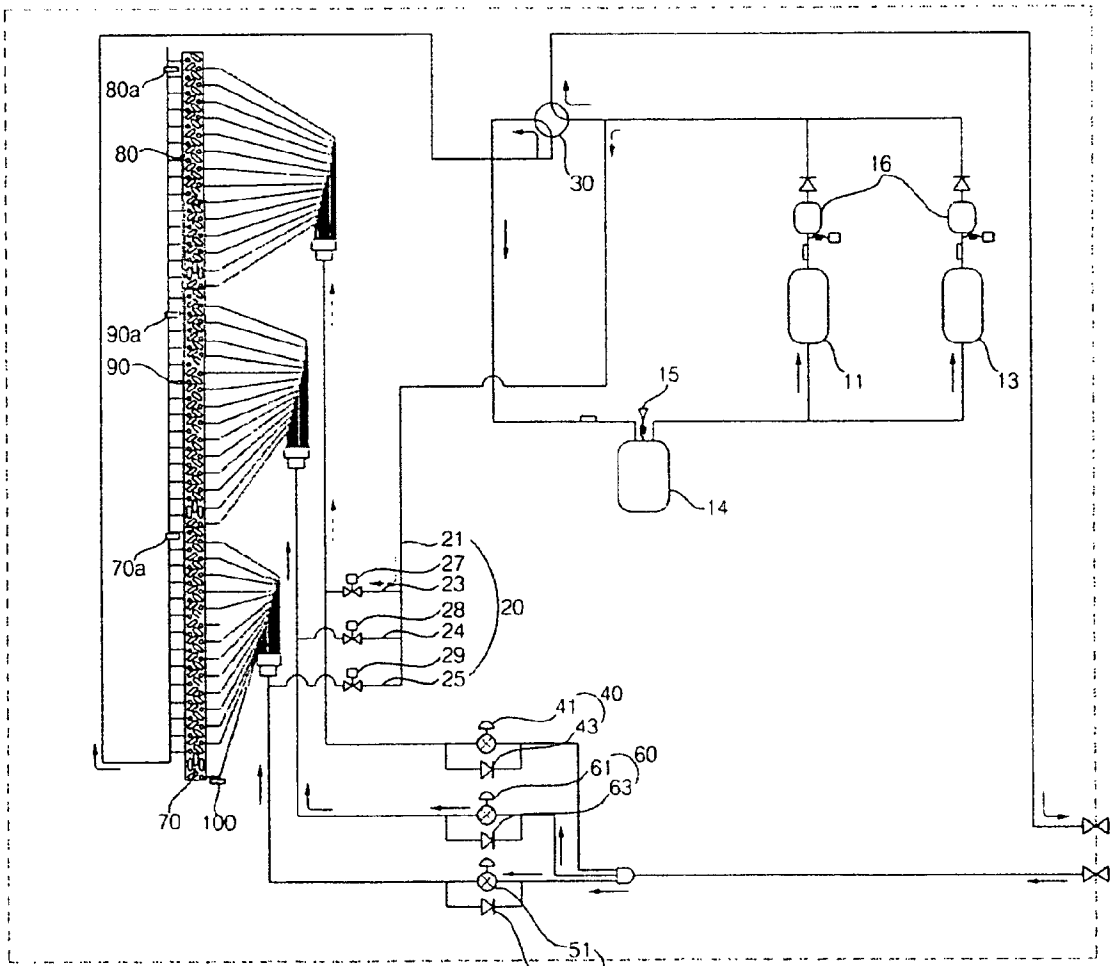
FIG. 7 is a block diagram illustrating the flow of refrigerant in an outdoor unit during a defrosting operation of a first outdoor heat exchanger according to a second embodiment of the present invention.
Figure 8:
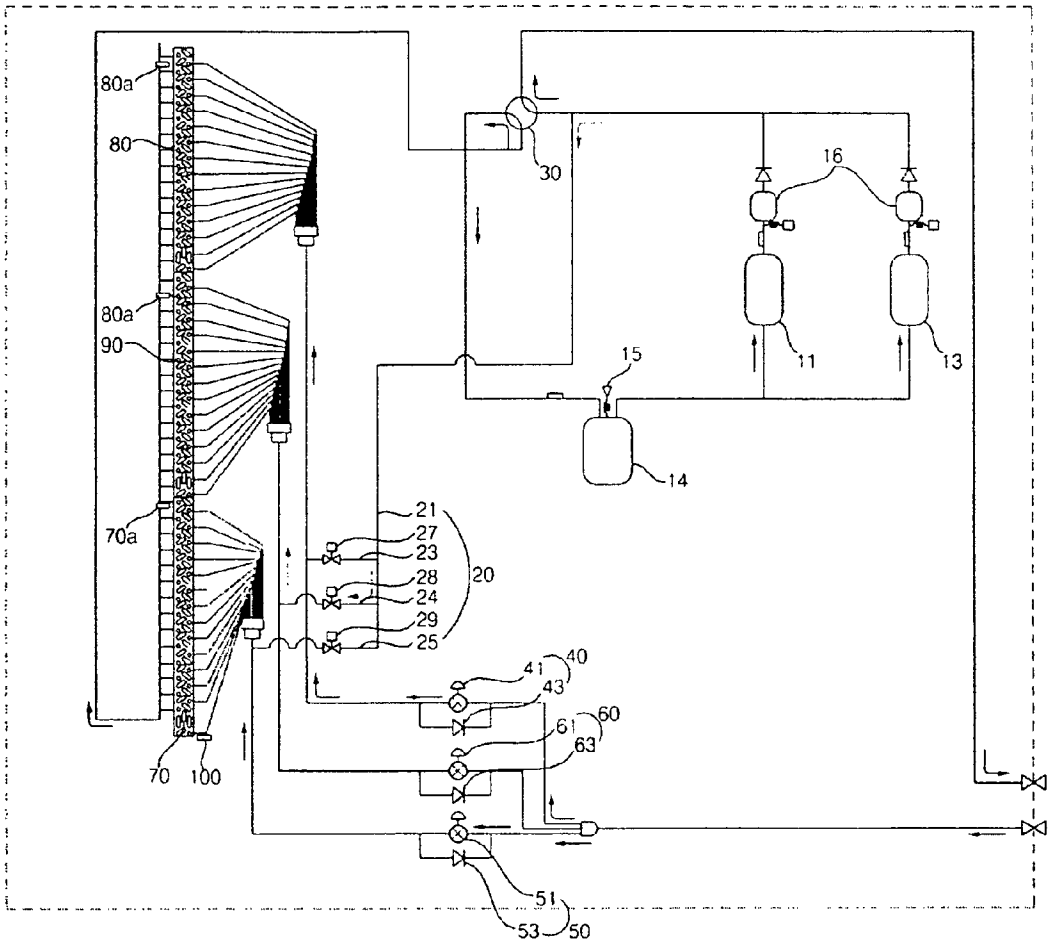
FIG. 8 is a block diagram illustrating the flow of refrigerant in the outdoor unit during a defrosting operation of a second outdoor heat exchanger according to the second embodiment of the present invention.
Figure 9:
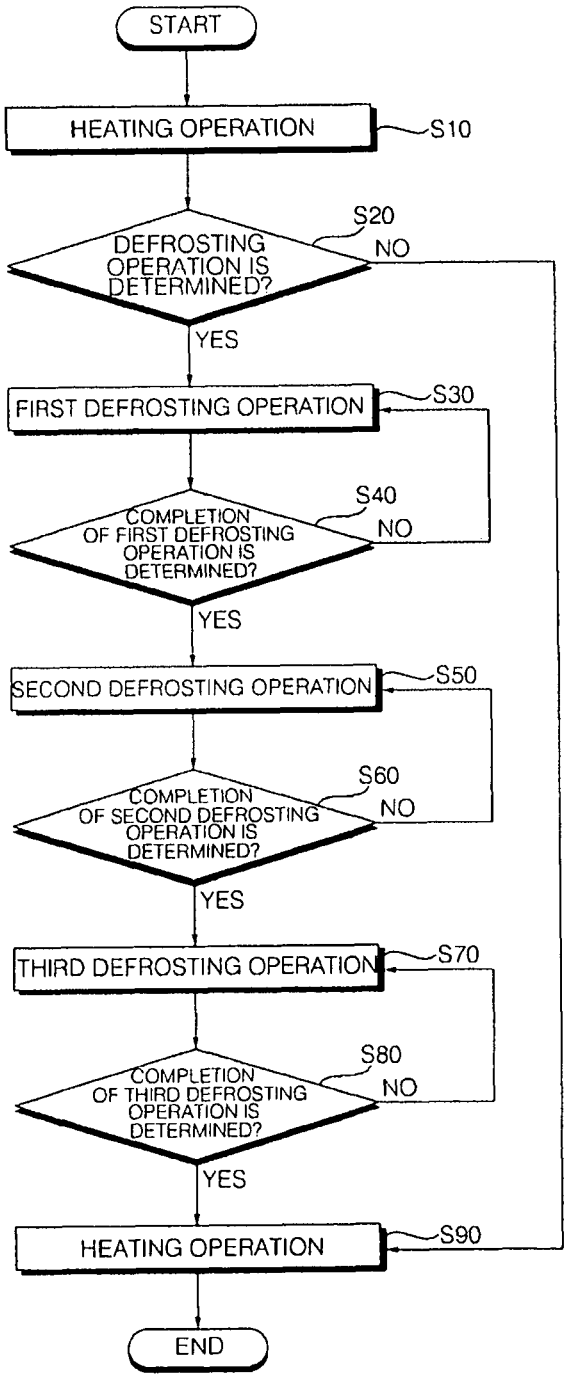
FIG. 9 is a flow chart illustrating a defrosting operation method of an air conditioner according to the second embodiment of the present invention.

FIG. 7 is a block diagram illustrating the flow of refrigerant during a defrosting operation of the first outdoor heat exchanger according to a second embodiment of the present invention, FIG. 8 is a block diagram illustrating the flow of refrigerant during a defrosting operation of the second outdoor heat exchanger according to the second embodiment, and FIG. 9 is a flow chart illustrating the defrosting method of an air conditioner according to the second embodiment.

Hereinafter, the second embodiment of the present invention will be described with reference to FIGS. 7 to 9.

The air conditioner according to the second embodiment of the present invention includes the first outdoor heat exchanger 80, the second outdoor heat exchanger 70, and a third outdoor heat exchanger 90. Accordingly, there are first to third outdoor expansion units 40, 50 and 60 and first to third defrosting valves 27, 28 and 29. Hereinafter, other configurations of the present embodiment are the same as those of the previously described first embodiment and thus, a description thereof will not be included.

In the present embodiment and differently from the previously described first embodiment, the three outdoor heat exchangers 70, 80 and 90 sequentially perform a defrosting operation, so that some of the outdoor heat exchangers perform a heating operation while others are performing a defrosting operation. More specifically, while one outdoor heat exchanger is performing a defrosting operation, the remaining two outdoor heat exchangers repeatedly perform a heating operation. Accordingly, the present embodiment performs a defrosting operation in three stages, which is different from the first embodiment.

Specifically, a defrosting method of the air conditioner according to the second embodiment of the present invention includes implementing a heating operation (S10) and determining whether to implement a defrosting operation (S20), in the same manner as the previously described first embodiment.

Then, to implement a first defrosting operation, the first defrosting valve 27 is opened, whereas the first expansion valve 41 is kept at a minimum opening rate or is closed. Accordingly, high temperature and high pressure refrigerant, diverted from the compressors 11 and 13 to the main pipe 21, is introduced into the first outdoor heat exchanger 80, allowing the first outdoor heat exchanger 80 to perform a defrosting operation (S30). In this case, the second outdoor heat exchanger 70 performs a heating operation as the refrigerant, having passed through the indoor heat exchanger (not shown) and the second expansion valve 51, is moved through the second outdoor heat exchanger 70. Also, the third outdoor heat exchanger 90 performs a heating operation as the refrigerant, having passed through the indoor heat exchanger (not shown) and the third expansion valve 61, is moved through the third outdoor heat exchanger 90.

When it is determined that the first defrosting operation of the first outdoor heat exchanger 80 is completed (S40), the first defrosting valve 27 is closed and the second defrosting valve 29 is opened, and the first expansion valve 41 is opened to a normal opening rate and the second expansion valve 51 is kept at a minimum opening rate or is closed, allowing the second outdoor heat exchanger 70 to implement a defrosting operation (S50).

Accordingly, in the second defrosting operation (S50), the second outdoor heat exchanger 70 performs a defrosting operation, and the first outdoor heat exchanger 80 and the third outdoor heat exchanger 90 perform a heating operation.

When it is determined that the second defrosting operation of the second outdoor heat exchanger 70 is completed (S60), a third defrosting operation is performed (S70).

In the third defrosting operation (S70), the second defrosting valve 29 is closed and the third defrosting valve 28 is opened. Also, the second expansion valve 51 is opened to a normal opening rate, whereas the third expansion valve 61 is kept at a minimum opening rate or is closed.

Accordingly, in the third defrosting operation (S70), the third outdoor heat exchanger 90 performs a defrosting operation, and the first outdoor heat exchanger 80 and the second outdoor heat exchanger 70 perform a heating operation.

When it is determined that the defrosting operation of the third outdoor heat exchanger 90 is completed (S80), all the defrosting valves 27, 28 and 29 are closed and all the expansion valves 41, 51 and 61 are opened to a normal opening rate, allowing all the outdoor heat exchangers 70, 80 and 90 to perform a heating operation.

Figure 10:
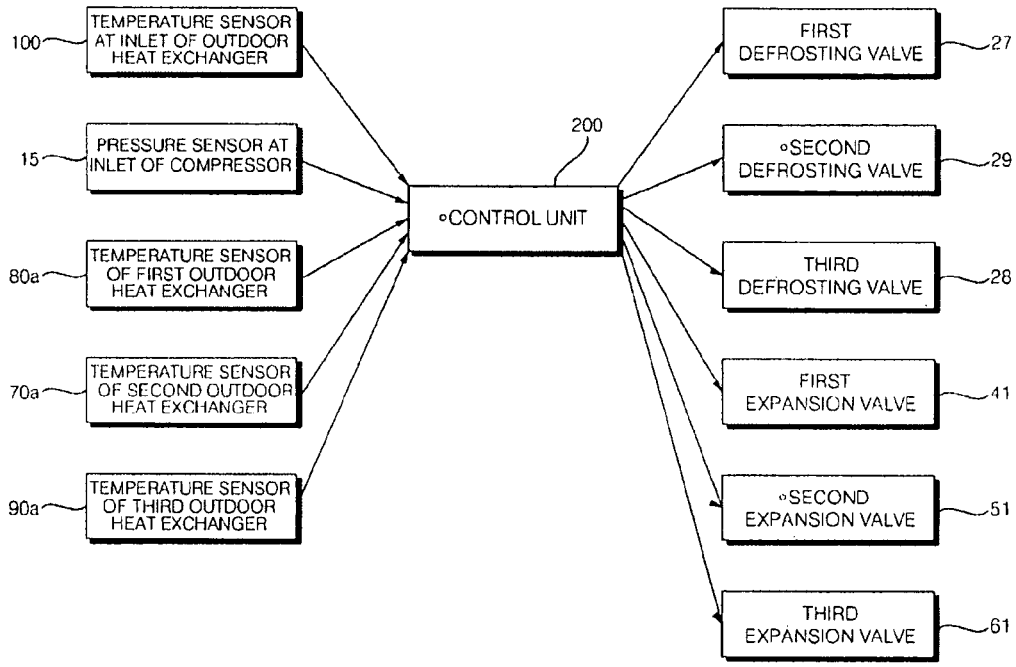
FIG. 10 is a control block diagram illustrating the defrosting operation of the air conditioner according to the second embodiment of the present invention.

FIG. 10 is a control block diagram illustrating the defrosting operation of the air conditioner according to the second embodiment. Referring to FIG. 10, as the number of the outdoor heat exchangers increases by one, a temperature sensor 90*a* is additionally provided to measure a temperature of the refrigerant discharged from the third outdoor heat exchanger 90, so as to determine whether to perform the third defrosting operation. Also, based on the determined result of the control unit 200, the third defrosting valve 28 and the third expansion valve 61 are additionally provided to adjust the flow of refrigerant to the third outdoor heat exchanger 90. Otherwise the configuration of FIG. 10 is the same as that of FIG. 6 (illustrating the control block diagram of the first embodiment) and thus, a description thereof will not be included.

Figure 11:
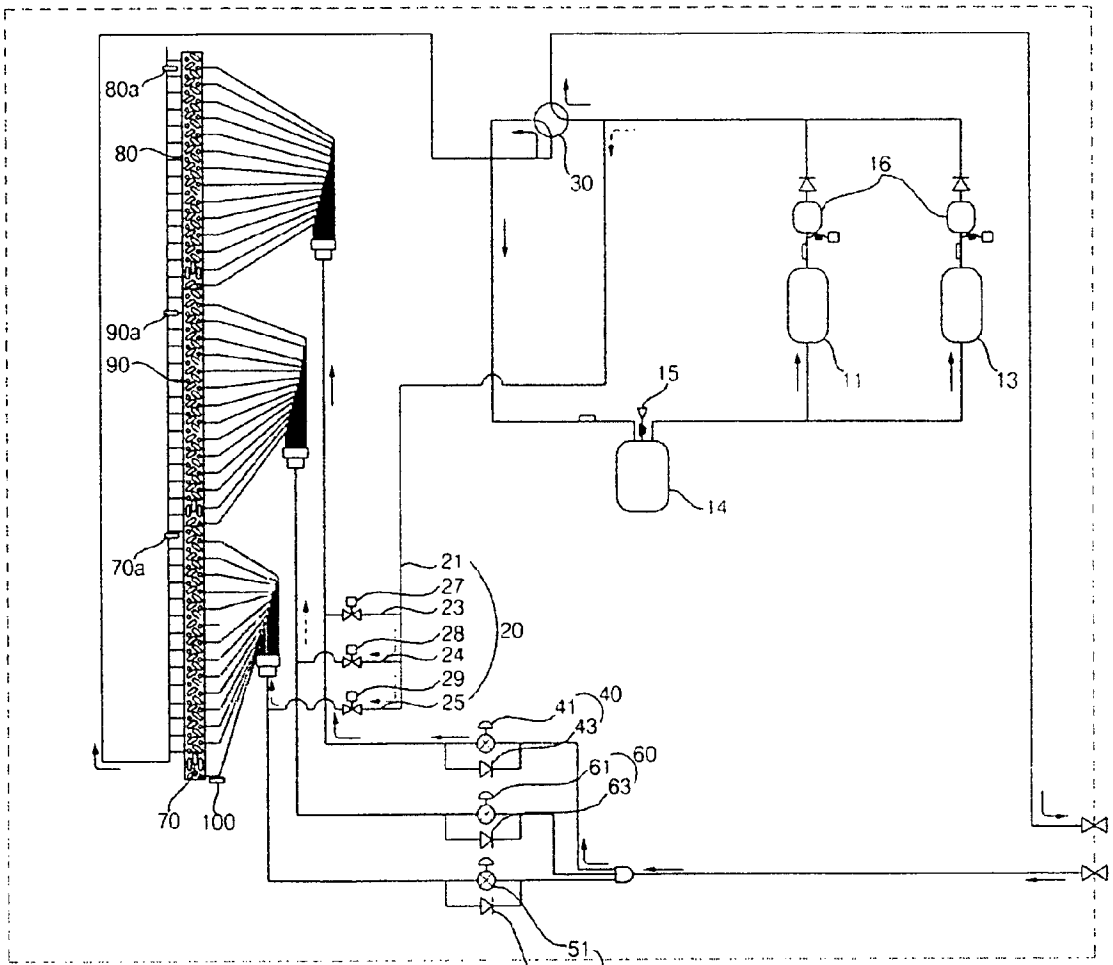
FIG. 11 is a configuration view illustrating the flow of refrigerant in the outdoor unit during the defrosting operation of the second outdoor heat exchanger and a third outdoor heat exchanger of an air conditioner according to a third embodiment of the present invention.
Figure 12:
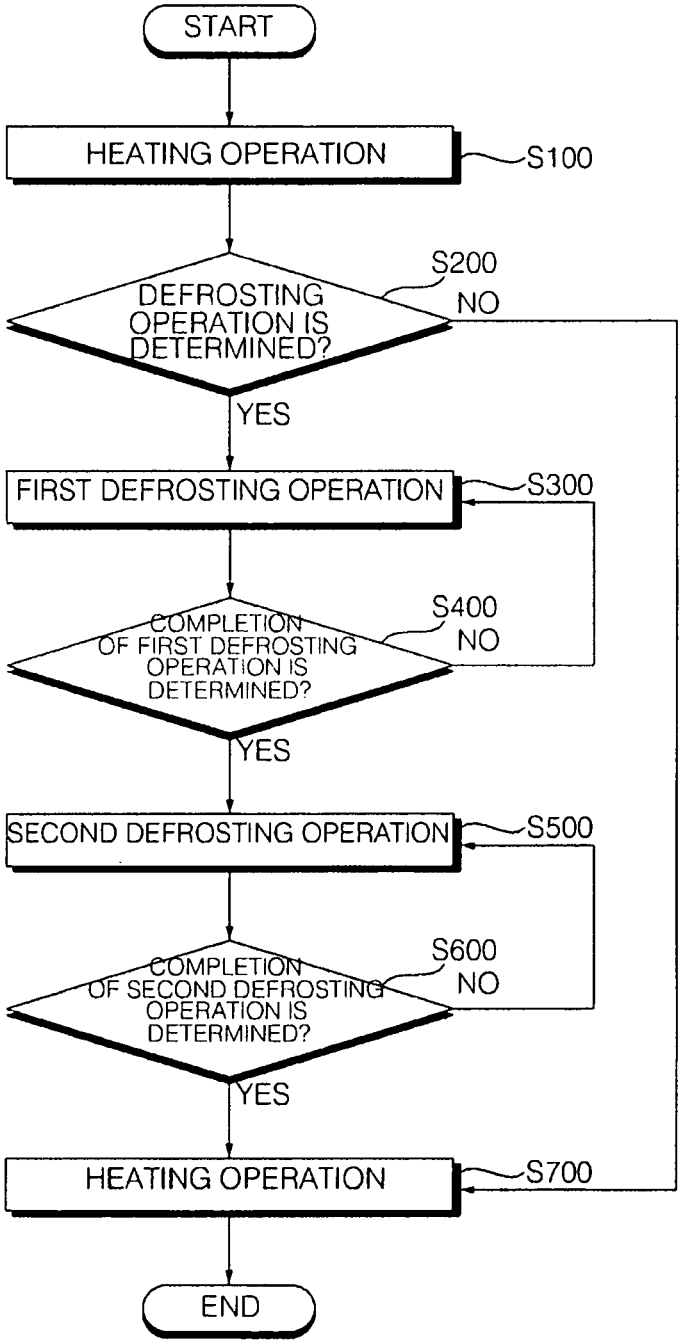
FIG. 12 is a flow chart illustrating a defrosting operation method of the air conditioner according to the third embodiment of the present invention.

FIG. 11 is a configuration illustrating the flow of refrigerant during a defrosting operation of the second outdoor heat exchanger and the third outdoor heat exchanger of an air conditioner according to a third embodiment of the present invention, and FIG. 12 is a flow chart illustrating a defrosting operation method of the air conditioner according to the third embodiment.

The general configuration of the present embodiment is the same as that of the previously described second embodiment and thus, a description thereof will not be included.

Also, the defrosting method of the present embodiment includes performing a heating operation (S100), determining whether to perform a defrosting operation (S200), performing a first defrosting operation (S300), and determining when to complete the first defrosting operation (S400), in the same manner as those of the second embodiment and thus, a description thereof will not be included.

Referring to FIGS. 11 and 12, to implement a second defrosting operation, the first outdoor heat exchanger 80 performs a heating operation, and the second outdoor heat exchanger 70 and the third outdoor heat exchanger 90 implement a defrosting operation (S500).

Accordingly, when it is determined that the first defrosting operation is completed (S400), in the second defrosting operation (S500), the first defrosting valve 27 is closed, and the second defrosting valve 29 and the third defrosting valve 28 are opened. Also, the second expansion valve 51 and the third expansion valve 61 are kept at a minimum opening rate or are closed, and the first expansion valve 41 is opened to a normal opening rate.

Then, it is determined when to complete the second defrosting operation by measuring a temperature of the refrigerant discharged from the second outdoor heat exchanger 70 and a temperature of the refrigerant discharged from the third outdoor heat exchanger 90 (S600).

When it is determined that the defrosting operation of the second outdoor heat exchanger 70 and the third outdoor heat exchanger 70 is completed, all the defrosting valves 27, 28 and 29 are closed, and all the expansion valves 41, 51 and 61 are opened to a normal opening rate, allowing a heating operation to be implemented (S700).

In the third embodiment of the present invention, the plurality of heat exchangers is divided into a heat exchanger group for implementing a defrosting operation and a heat exchanger group for implementing a heating operation, allowing the heat exchanger groups to sequentially implement a defrosting operation. Specifically, in the present embodiment, the three outdoor heat exchangers are divided into one outdoor heat exchanger and two outdoor heat exchangers, enabling sequential implementation of a defrosting operation. However, it will be appreciated that four outdoor heat exchangers may be divided into one and three for sequential implementation of a defrosting operation.

In addition, it will be appreciated that five outdoor heat exchangers may be divided into three groups of one, one, and three, or of one, two, and two, for sequential implementation of a defrosting operation.

Other configurations and operations of the third embodiment of the present invention are the same as those of the first and second embodiments of the present invention and thus, a description thereof will not be included.

It will be understood by those skilled in the art that these example embodiments may be implemented in other specific forms without changing the technical spirit or essential features of the present invention. Therefore, it should be noted that the forgoing embodiments are merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

According to an air conditioner and a defrosting method of the air conditioner according to the present invention, one or more effects as follows may be achieved.

First, heated air may be continuously supplied into a room even while an outdoor heat exchanger is implementing a defrosting operation.

Second, it is unnecessary to stop a heating operation for performance of a regular defrosting operation, and this may enhance heating efficiency of the overall system.

Third, a normal heating operation may be rapidly implemented as soon as a defrosting operation is completed because there is no need for a preheating time of an indoor heat exchanger for performance of the heating operation.

The effects of the present invention are not limited to the above-mentioned effects, and other effects not mentioned above can be clearly understood from the definitions in the claims by one skilled in the art.

What is claimed is:

1. An air conditioner comprising:

a compressor to compress refrigerant;

a hot gas pipe that receives a part of the refrigerant compressed in the compressor;

a 4-way valve that receives the remaining refrigerant compressed in the compressor;

an indoor heat exchanger that receives the refrigerant from the 4-way valve and that exchanges heat with indoor air; and a plurality of outdoor heat exchangers, some of which implement a heating operation as the heat-exchanged refrigerant is received from the indoor heat exchanger and passes therethrough while others implement a defrosting operation as the refrigerant is received from the hot gas pipe, wherein the hot gas pipe includes:

a main pipe with one end connected between the compressor and the 4-way valve;

a plurality of connecting pipes to connect the main pipe and the plurality of outdoor heat exchangers to each other; and a plurality of defrosting valves installed on each of the plurality of connecting pipes.

2. The air conditioner of claim 1, wherein:

the plurality of outdoor heat exchangers includes a first outdoor heat exchanger and a second outdoor heat exchanger;

the plurality of connecting pipes includes a first connecting pipe communicating with the first outdoor heat exchanger and a second connecting pipe communicating with the second outdoor heat exchanger; and the plurality of defrosting valves includes a first defrosting valve installed on the first connecting pipe and a second defrosting valve installed on the second connecting pipe.

3. The air conditioner of claim 2, wherein the first outdoor heat exchanger implements a defrosting operation by receiving the refrigerant from the hot gas pipe and thereafter implements a heating operation by receiving the heat-exchanged refrigerant from the indoor heat exchanger.

4. The air conditioner of claim 3, wherein the second outdoor heat exchanger implements a heating operation by receiving the heat-exchanged refrigerant from the indoor heat exchanger when the first outdoor heat exchanger implements the defrosting operation.

5. The air conditioner of claim 3, wherein the second outdoor heat exchanger implements a defrosting operation by receiving the refrigerant from the hot gas pipe when the first outdoor heat exchanger implements the heating operation.

6. The air conditioner of claim 3, wherein the first defrosting valve is opened during the defrosting operation of the first outdoor heat exchanger.

7. The air conditioner of claim 6, wherein the first defrosting valve is closed during the heating operation of the first outdoor heat exchanger.

8. The air conditioner of claim 3, further comprising a first expansion valve located between the first outdoor heat exchanger and the indoor heat exchanger, wherein an opening rate of the first expansion valve is limited to a minimum opening rate during the defrosting operation of the first outdoor heat exchanger.

9. The air conditioner of claim 8, wherein the first expansion valve is set to a normal opening rate during the heating operation of the first outdoor heat exchanger.

10. The air conditioner of claim 1, further comprising an outdoor expansion unit to expand the heat-exchanged refrigerant from the indoor heat exchanger.

11. The air conditioner of claim 10, wherein the outdoor expansion unit includes a plurality of expansion valves to expand the refrigerant to be introduced into the plurality of outdoor heat exchangers.

12. A defrosting method of an air conditioner comprising:

performing a heating operation by moving refrigerant compressed in a compressor into an indoor heat exchanger;

sequentially performing a defrosting operation of a plurality of outdoor heat exchangers by moving a part of the compressed refrigerant from the compressor into some of the plurality of outdoor heat exchangers; and resuming the heating operation by moving all of the compressed refrigerant from the compressor into the indoor heat exchanger, wherein the defrosting operation method further comprising:

determining a defrosting condition by measuring a temperature of outdoor air at the plurality of outdoor heat exchangers or a pressure of the refrigerant at an inlet of the compressor, wherein the defrosting operation is performed when the defrosting condition is present.

13. A defrosting method of an air conditioner comprising:

performing a heating operation by moving refrigerant compressed in a compressor into an indoor heat exchanger;

sequentially performing a defrosting operation of a plurality of outdoor heat exchangers by moving a part of the compressed refrigerant from the compressor into some of the plurality of outdoor heat exchangers; and resuming the heating operation by moving all of the compressed refrigerant from the compressor into the indoor heat exchanger, wherein the plurality of outdoor heat exchangers includes a first outdoor heat exchanger and a second outdoor heat exchanger; and the performance of the defrosting operation includes:

performing a first defrosting operation in such a manner that the first outdoor heat exchanger performs a defrosting operation by receiving a part of the refrigerant compressed in the compressor and the second outdoor heat exchanger performs a heating operation by receiving the refrigerant discharged from the indoor heat exchanger; and performing a second defrosting operation in such a manner that the second outdoor heat exchanger performs a defrosting operation by receiving a part of the refrigerant compressed in the compressor and the first outdoor heat exchanger performs a heating operation by receiving the refrigerant discharged from the indoor heat exchanger.

14. The defrosting operation method of claim 13, wherein the performance of the defrosting operation includes:

determining when to complete the first defrosting operation by measuring a temperature of the refrigerant at the first outdoor heat exchanger; and determining when to complete the second defrosting operation by measuring a temperature of the refrigerant at the second outdoor heat exchanger.

15. The defrosting operation method of claim 13, wherein the performance of the first defrosting operation includes:

opening a first defrosting valve to cause a part of the refrigerant compressed in the compressor to be diverted into the first outdoor heat exchanger; and limiting an opening rate of a first expansion valve, located between the first outdoor heat exchanger and the indoor heat exchanger, to a minimum opening rate.

16. The defrosting operation method of claim 15, wherein the performance of the second defrosting operation includes:

closing the first defrosting valve and opening a second defrosting valve to cause a part of the refrigerant compressed in the compressor to be diverted into the second outdoor heat exchanger; and setting the first expansion valve to a normal opening rate and limiting an opening rate of a second expansion valve, located between the second outdoor heat exchanger and the indoor heat exchanger, to a minimum opening rate.

17. The defrosting method of claim 12, wherein:

the plurality of outdoor heat exchangers includes a first outdoor heat exchanger, a second outdoor heat exchanger, and a third outdoor heat exchanger; and the performance of the defrosting operation includes:

performing a first defrosting operation by diverting a part of the refrigerant compressed in the compressor into the first outdoor heat exchanger and the second outdoor heat exchanger and the third outdoor heat exchanger performs a heating operation as the refrigerant discharged from the indoor heat exchanger is diverted into the second outdoor heat exchanger and the third outdoor heat exchanger;

performing a second defrosting operation by diverting a part of the refrigerant compressed in the compressor into the second outdoor heat exchanger and the first outdoor heat exchanger and the third outdoor heat exchanger perform a heating operation as the refrigerant discharged from the indoor heat exchanger is diverted into the first outdoor heat exchanger and the third outdoor heat exchanger; and performing a third defrosting operation by diverting a part of the refrigerant compressed in the compressor into the third outdoor heat exchanger and the first outdoor heat exchanger and the second outdoor heat exchanger perform a heating operation as the refrigerant discharged from the indoor heat exchanger is diverted into the first outdoor heat exchanger and the second outdoor heat exchanger.

18. The defrosting operation method of claim 12, wherein:

the plurality of outdoor heat exchangers includes a first outdoor heat exchanger, a second outdoor heat exchanger, and a third outdoor heat exchanger; and the performance of the defrosting operation includes:

performing a first defrosting operation by diverting a part of the refrigerant compressed in the compressor into the first outdoor heat exchanger and the second outdoor heat exchanger and the third outdoor heat exchanger perform a heating operation as the refrigerant discharged from the indoor heat exchanger is diverted into the second outdoor heat exchanger and the third outdoor heat exchanger; and performing a second defrosting operation by diverting a part of the refrigerant compressed in the compressor into the second outdoor heat exchanger and the third outdoor heat exchanger and the first outdoor heat exchanger performs a heating operation as the refrigerant discharged from the indoor heat exchanger is diverted into the first outdoor heat exchanger.

19. An air conditioner comprising:

a compressor to compress refrigerant;

a hot gas pipe that receives a part of the refrigerant compressed in the compressor;

a 4-way valve that receives the remaining refrigerant compressed in the compressor;

an indoor heat exchanger that receives the refrigerant from the 4-way valve and that exchanges heat with indoor air;

a plurality of outdoor heat exchangers with a sensor that detects frosting of the heat exchanger, some of which implement a heating operation as the heat-exchanged refrigerant from is received from the indoor heat exchanger and passes therethrough while others implement a defrosting operation as the refrigerant is received from the hot gas pipe; and a controller receiving a frosting indication from the plurality of sensors, the controller controlling the defrosting of the outdoor heat exchangers according to the frosting indication, wherein the sensor is a first temperature sensor that measures the temperature of refrigerant discharged from the outdoor heat exchanger.

20. The air conditioner of claim 19, further comprising a plurality of defrost valves each between the hot gas pipe and an input to each of the outdoor heat exchangers.

21. The air conditioner of claim 20, wherein the controller opens one of the defrost valves to defrost the attached outdoor heat exchanger.

22. The air conditioner of claim 19, wherein the sensor further includes a second temperature sensor that measures an outdoor air temperature at the outdoor heat exchanger.

23. The air conditioner of claim 22, wherein the outdoor air temperatures is of outdoor air that has passed through the outdoor heat exchanger.

* * * * *